US006024321A

United States Patent [19]

Miyake

[11] Patent Number: 6,024,321

[45] Date of Patent: Feb. 15, 2000

[54] MECHANISM FOR AUTOMATICALLY LOADING A PAPER ROLL

[75] Inventor: Hiromasa Miyake, Tokyo, Japan

[73] Assignee: NEC Corporation, Tokyo, Japan

[21] Appl. No.: 09/240,677

[22] Filed: Feb. 2, 1999

[30] Foreign Application Priority Data

Feb. 2, 1998 [JP] Japan ..... 10-021256

[51] Int. Cl.[7] ..... B65H 16/08; B65H 26/00

[52] U.S. Cl. ..... 242/562.1; 242/563; 242/564.5

[58] Field of Search ..... 242/562, 562.1, 242/563, 564.5, 332.1, 332.2, 332.5

[56] References Cited

U.S. PATENT DOCUMENTS 5,366,174 11/1994 Tsukamoto et al. ..... 242/562
5,706,875 1/1998 Simon ..... 242/563
5,947,408 9/1999 Miyake ..... 242/562

FOREIGN PATENT DOCUMENTS 59-22840 2/1984 Japan .
2-110064 4/1990 Japan .
3-293251 12/1991 Japan .
4-301476 10/1992 Japan .
8-133534 5/1996 Japan .

*Primary Examiner*—John M. Jillions
*Attorney, Agent, or Firm*—Foley & Lardner

[57] ABSTRACT

In accordance with the present invention an automatic paper roll loading mechanism intentionally produces a slack on the surface of a paper roll, indirectly senses the leading edge of the paper of the roller via the slack, and conveys the leading edge to a preselected stand-by position. The mechanism is therefore capable of automatically paying out the paper even when a mark is absent at the leading edge. This allows not only a fresh paper roll but also a half-used paper roll to be automatically loaded.

4 Claims, 6 Drawing Sheets

MECHANISM FOR AUTOMATICALLY LOADING A PAPER ROLL

BACKGROUND OF THE INVENTION

The present invention relates to a mechanism for automatically loading a printer or similar apparatus with a paper roll.

A conventional automatic paper roll loading mechanism is taught in, e.g., Japanese Patent Laid-Open Publication No. 3-293251. The conventional mechanism includes a sensor for sensing a mark provided on the leading edge of paper implemented as a roll. The mechanism starts paying out the paper from the roll when the sensor senses the leading edge of the paper. This, however, brings about a problem that the mechanism cannot start paying out the paper when the mark to be sensed by the sensor is absent at the leading edge of the paper. It follows that the automatic loading function of the mechanism does not work when use is made of a half-used paper roll.

Technologies relating to the present invention are also disclosed in, e.g., Japanese Patent Laid-Open Publication Nos. 59-22840, 2-110064, 4-301476, and 8-133534.

SUMMARY OF THE INVENTION

It is therefore an object of the present invention to provide a mechanism capable of automatically loading not only a fresh paper roll but also a half-used paper roll.

In accordance with the present invention, a mechanism for automatically loading a paper roll by rotating a front roller and a rear roller, which are positioned below a paper roll setting position and spaced from each other in the direction of paper feed, while causing the circumference of the paper roll to contact the front roller and rear roller, includes a separator positioned between the front roller and the rear roller for separating the leading edge of paper of the paper roll from the surface of the roll. A slack sensing devices senses a preselected amount of slack produced on the surface of the paper roll. A controller controls the rotation of the front roller and rear roller in accordance with the output signal of the slack sensing device. The controller rotates at least one of the front roller and rear roller to thereby produce the preselected amount of slack between the front roller and the rear roller, then rotates the front roller and rear roller in the direction opposite to the direction of paper feed, then further rotates, when the slack sensing device senses a decrease of the predetermined amount of slack, the front roller and rear roller by a preselected amount, then stops rotating the front roller and rear roller, and then rotates the front roller and rear roller in the direction of paper feed, thereby feeding the leading edge of the paper to the separator.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
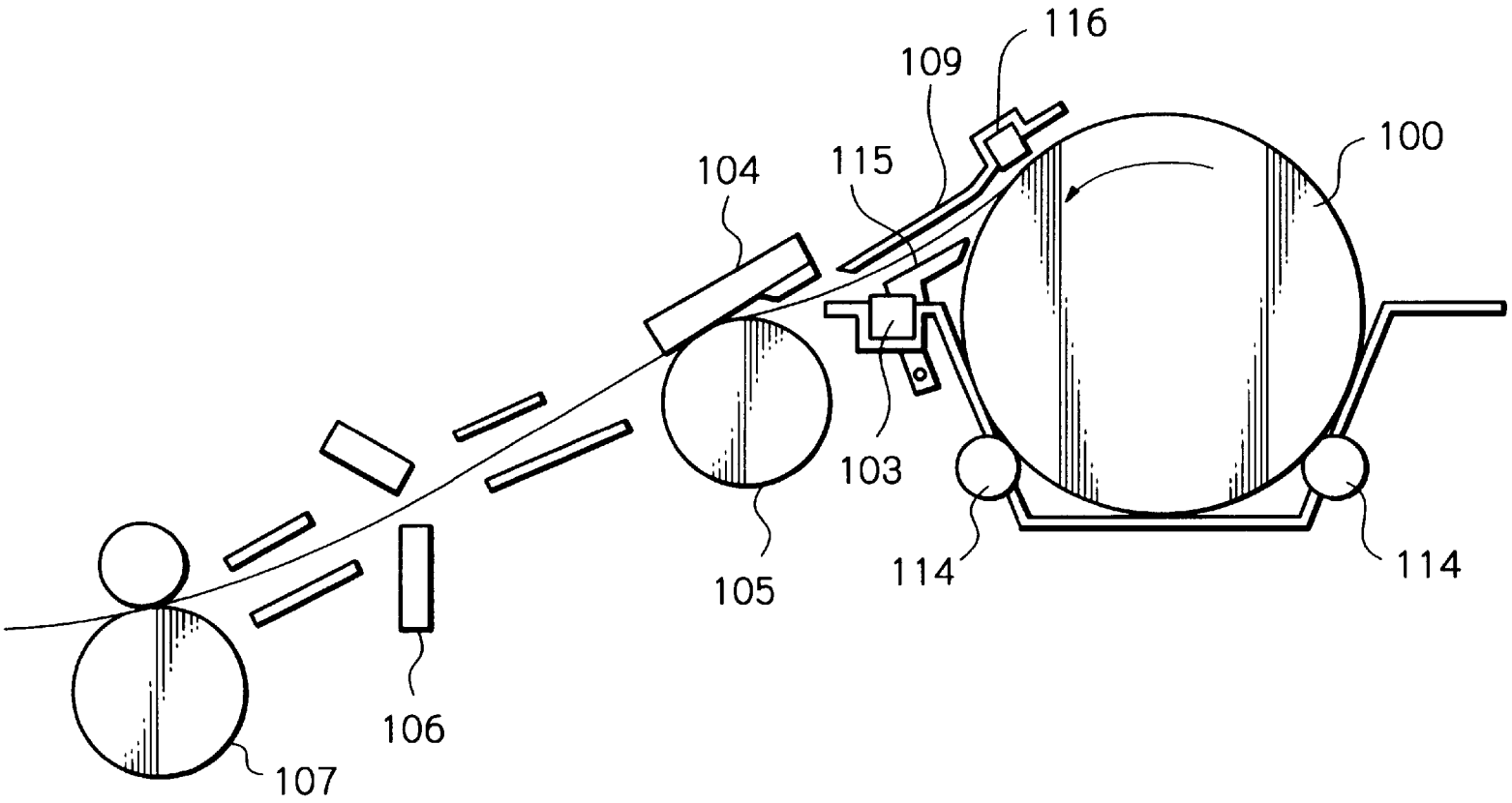
Fig. 1 PRIOR ART
FIG. 1 is a side elevation showing a conventional automatic paper roll loading mechanism.

To better understand the present invention, brief reference will be made to a conventional mechanism for automatically loading a paper roll, shown in FIG. 1. The mechanism to be described is taught in Laid-Open Publication No. 3-293251 mentioned earlier. As shown, the mechanism includes a sensor 116 for sensing a mark provided on the leading edge of paper implemented as a roll 100. When the sensor 116 senses the mark of the paper of the roll 100 being rotated, a separation guide 115 is moved to a preselected position. When the edge of the separation guide 115 is positioned between the paper and the circumference of the roll 100, it separates the leading edge of the paper from the roll 100. As the roll 100 is further rotated, the leading edge of the paper is brought to a nip between a platen roller 105 and a thermal head 104 along a guide 109. As soon as the leading edge of the paper arrive at a sensor 103, the platen roller 105 and a discharge roller 17 start rotating in response to the resulting output of the sensor 103. At the same time, roll drive rollers 114 are caused to stop rotating while the separation guide 115 is returned to its original position. Subsequently, the leading edge of the paper is conveyed to a cutter 106 and the discharge roller 107 away from the nip between the platen roller 105 and the thermal head 104.

The above conventional mechanism has the problem stated earlier.

Figure 2:
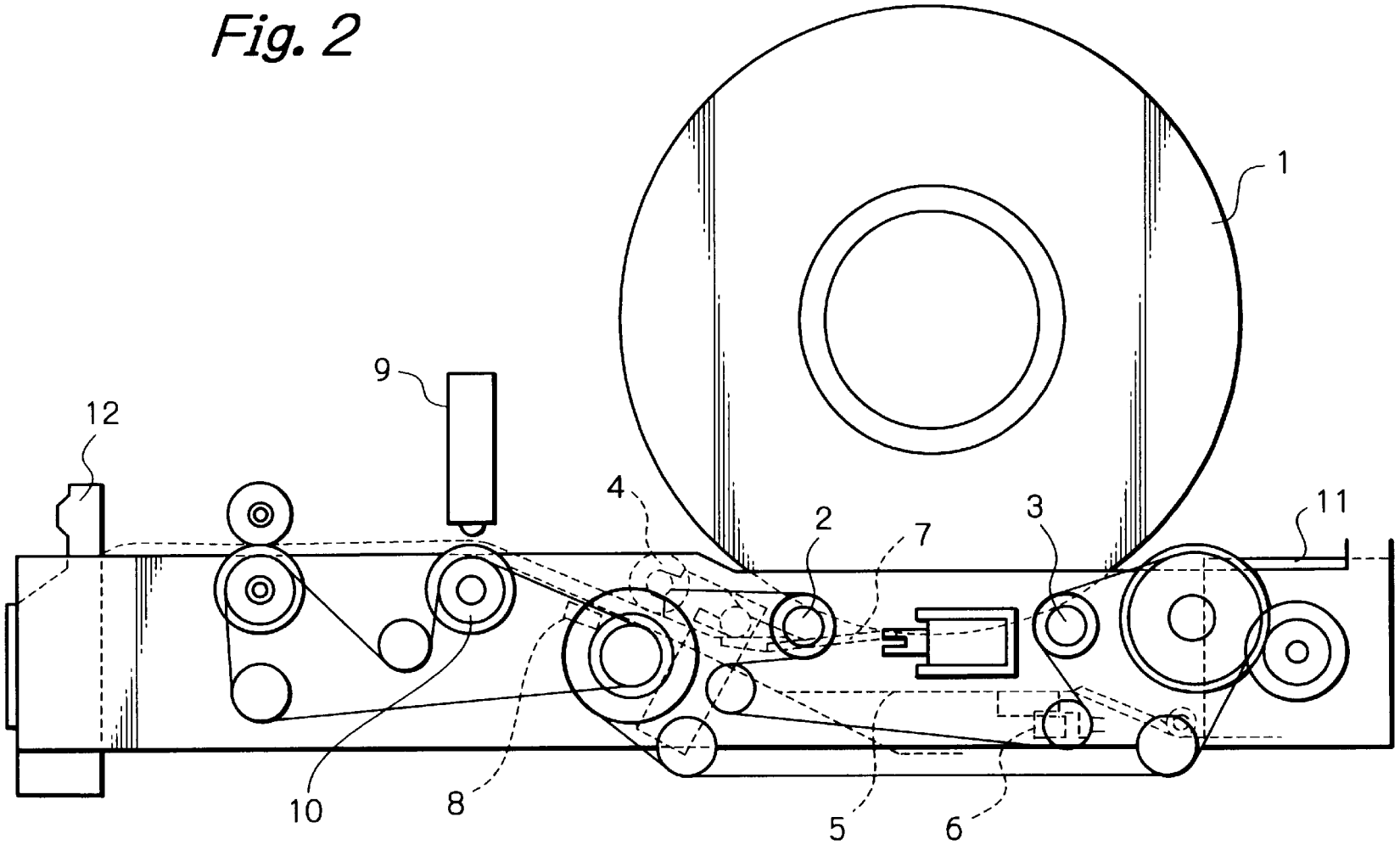
FIG. 2 is a side elevation showing an automatic paper roll loading mechanism embodying the present invention.
Figure 3:
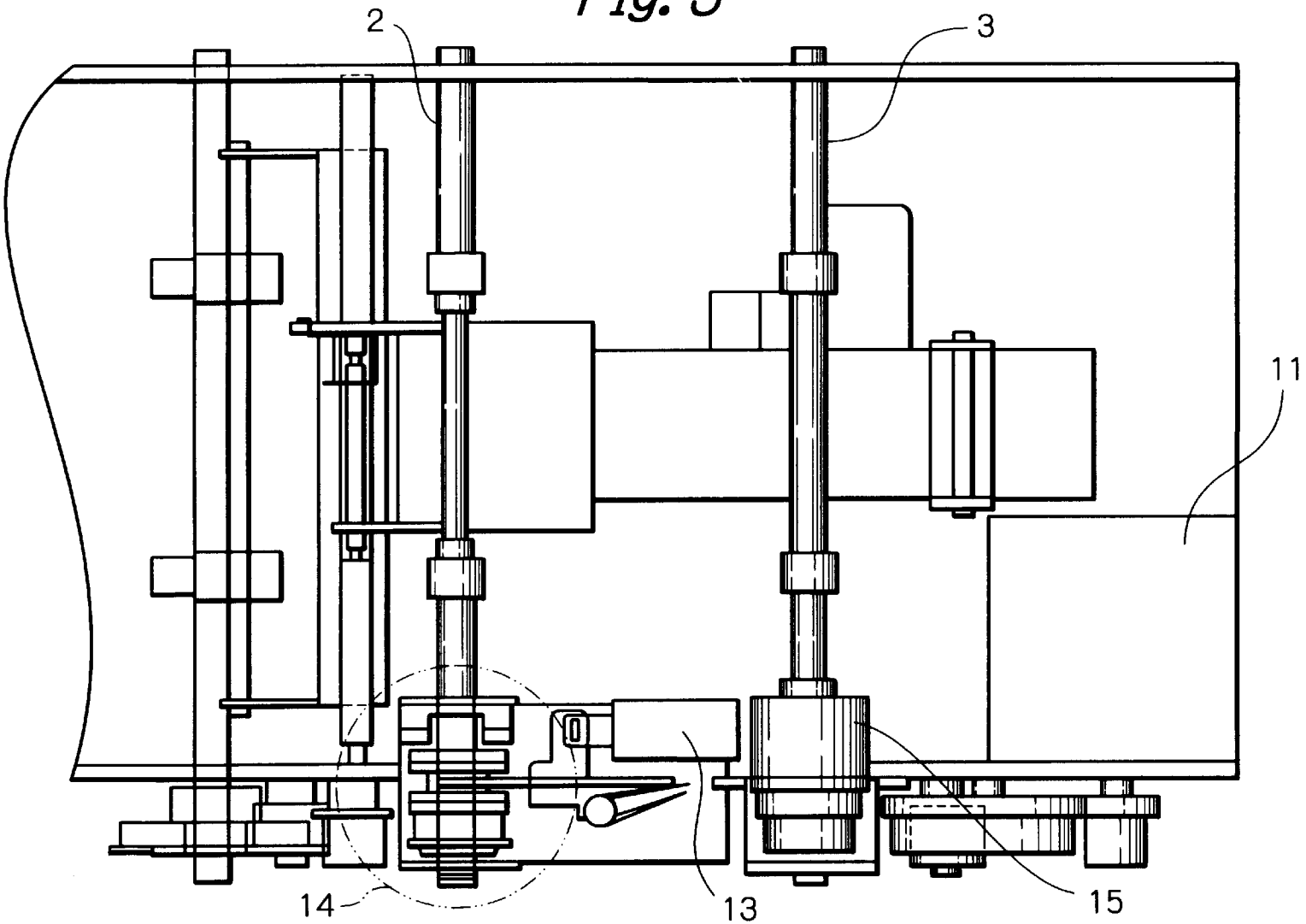
FIGS. 3 through 12 are fragmentary side elevations demonstrating consecutive conditions to occur during the operation of the illustrative embodiment.

Referring to FIGS. 2 and 3, an automatic paper roll loading mechanism embodying the present invention will be described. As shown, the mechanism includes a front roller 2 and a rear roller 3 for rotating a paper roll 1. The front roller 2 and rear roller 3 are located below a position where the paper roll 1 is to be set. The two rollers 2 and 3 are spaced from each other in a direction of paper feed, as illustrated. When the paper roll 1 is set in the above position, its circumference contacts the rollers 2 and 3.

A roller 4 conveys paper separated from the paper roll 1, as will be described specifically later. A slack sensing plate 5 swings due to a slack intentionally produced on the surface of the paper roll 1. A slack sensor 6 is responsive to such a movement of the slack sensing plate 5. The slack sensing plate 5 and slack sensor 6 constitute slack sensing means in combination. A separator 7 is lightly pressed against the surface of the paper roll 1 in order to separate the leading edge of the paper from the roll 1. A paper sensor 8 determines whether or not the paper is present. A print head 9 causes the paper to color by heating it and thereby prints data on the paper. A platen roller 10 conveys the paper while pressing it against the print head 9. A motor 11 drives the rollers 2, 3 and 4 and platen roller 10. A cutter 12 cuts the paper at a preselected length. The slack sensing plate 5 and separator 7 are positioned between the front roller 2 and the rear roller 3. When the surface of the paper roll 1 is caused to form a preselected amount of slack between the front roller 2 and the rear roller 3, the stack pushes the slack sensing plate 5 downward by a preselected amount. As a result, the slack sensor 6 outputs a detection signal.

As shown in FIG. 3, a clutch mechanism 14 is mounted on the shaft of the front roller 2. A solenoid 13 causes the clutch mechanism 14 to switch the condition of drive transmission between the motor 11 and the front roller 2. Specifically, when the solenoid 13 is turned on, it causes the clutch mechanism 14 to fully lock the front roller 2 and thereby interrupts drive transmission between the motor 11 and the front roller 2. When the solenoid 13 is turned off, it causes the clutch mechanism 14 to set up drive transmission between the motor 1 and the front roller 2.

A torque limiter 15 is mounted on the shaft of the rear roller 3. When friction exceeding a preselected value occurs between the rear roller 3 and the motor 11, it causes a load exceeding a preselected value to act on the rear roller 3. At this instant, the torque limiter 15 causes a slip to occur between the rear roller 3 and the motor 11, thereby protecting the motor 11 from an overload.

Control means, not shown, controls the motor 11, clutch mechanism 14 and other various structural elements of the mechanism in response to the output of the slack sensing means as well as the outputs of other sensors not shown.

Figure 4:
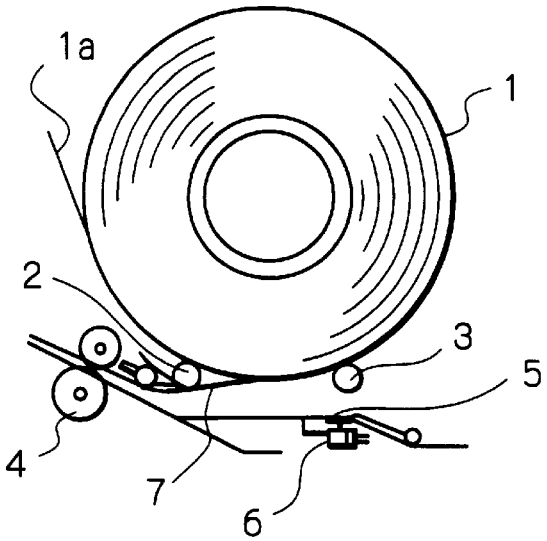

The functions of the control means will be described together with the operation of the automatic loading mechanism with reference to FIGS. 4–12. As shown in FIG. 4, the paper roll 1 is set on the front roller 2 and rear roller 3. While the leading edge 1*a* of the paper of the roll 1 may be located at any position, it is first assumed to exist at a position outside of the range between the front roller 2 and the rear roller 3.

Figure 5:
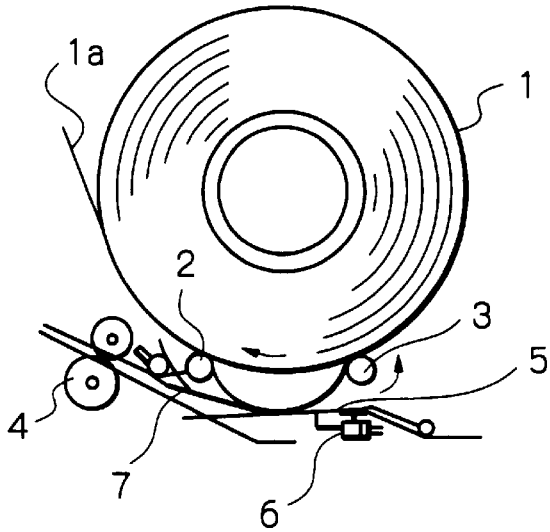

In the condition shown in FIG. 4, an auto-load command is input to the control means. In response, the control means turns on the solenoid 13 with the result the clutch mechanism 14 locks the front roller 2. At the same time, the control means drives the motor 11 such that the rear roller 3 rotates in a direction (counterclockwise) opposite to a direction of paper feed, as shown in FIG. 5. This causes the surface of the paper roll 1 to slacken between the front roller 2 having been locked and the rear roller 3 being rotated. The slack of the paper roll or paper 1 sequentially grows due to the rotation of the rear roller 3 and pushes the slack sensing plate 5 downward.

Figure 6:
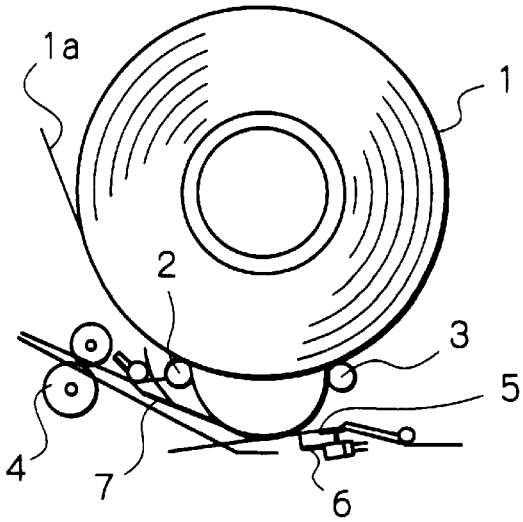
Figure 7:
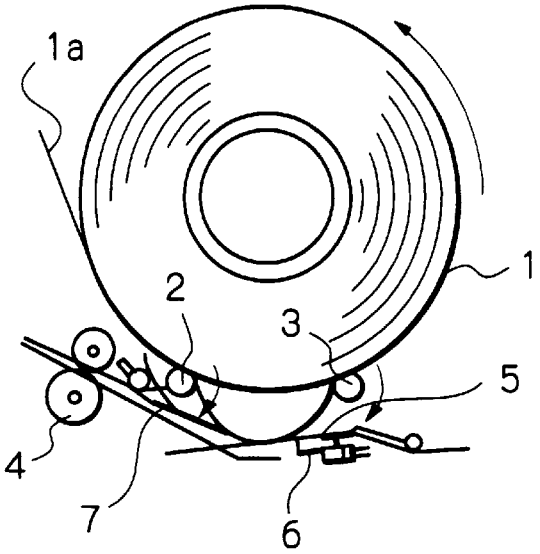
Figure 8:
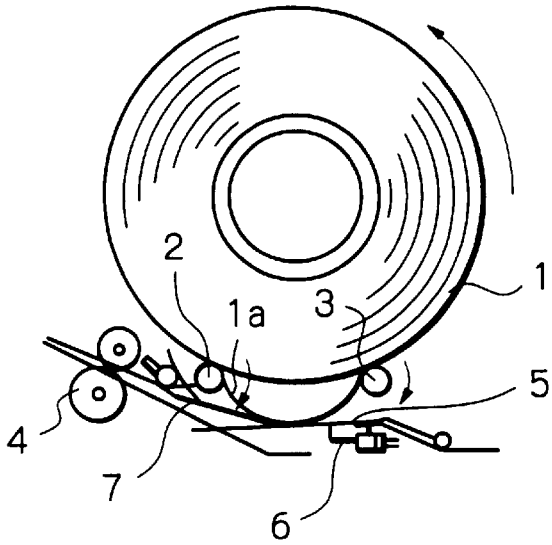
Figure 9:
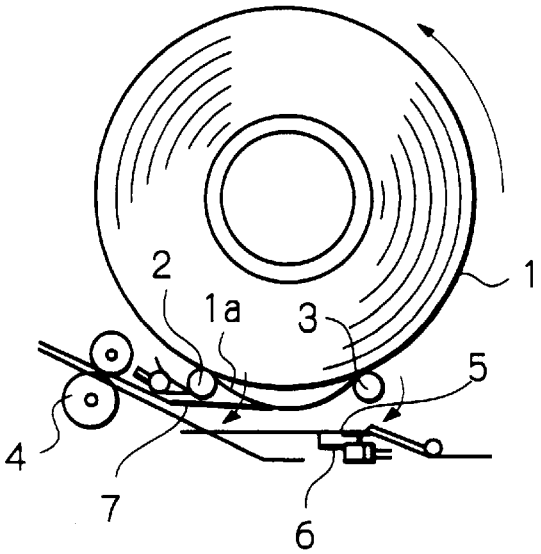

As shown in FIG. 6, the slack lowers the slack sensing plate 5 by more than a preselected amount, the slack sensor 6 turns on and sends a signal representative of the slack to the control means. In response, the control means further drives the motor 11 by a preselected amount and then stops it. Subsequently, the control means turns off the solenoid 13 and thereby unlocks the front roller 2, i.e., couples the rear roller 3 to the motor 11 via the clutch mechanism 14. Thereafter, as shown in FIG. 7, the control means drives the motor 11 in the reverse direction. As a result, both the front roller 2 and rear roller 3 are rotated clockwise, as viewed in FIG. 7, causing the paper roll 1 to rotate in the direction (counterclockwise) opposite to the direction of paper feed. Consequently, as shown in FIG. 8, the slack of the paper roll 1 begins to decrease when the leading edge 1*a* of the paper moves away from the front roller 2. Finally, the slack disappears, as shown in FIG. 9. At this time, the slack sensor 6 turns off, showing the control means the disappearance of the slack.

Figure 10:
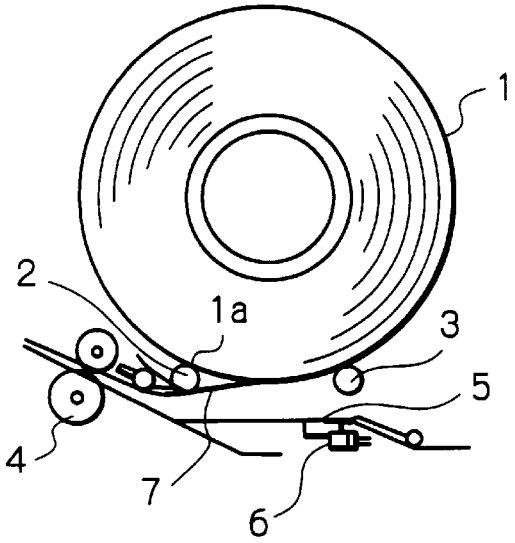
Figure 11:
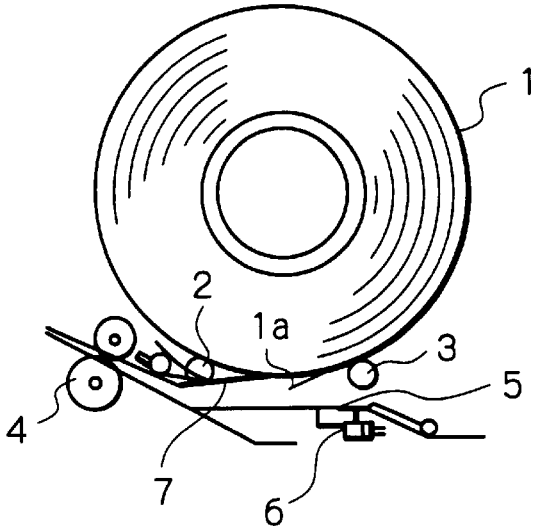
Figure 12:
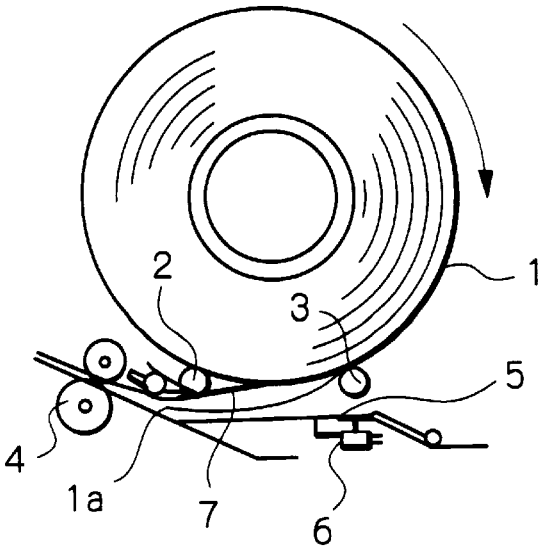

As shown in FIGS. 10 and 11, the control means informed of the disappearance of the slack further rotates the paper roller 1 by a preselected amount and then stops driving the motor 11. As a result, the leading edge 1*a* of the paper is brought to a position between the edge of the separator 7 and the rear roller 3. As shown in FIG. 12, the control means drives the motor 11 in the reverse direction in order to rotate the front roller 2 and rear roller 3 in the direction of paper feed, so that the paper roll 1 is rotated clockwise.

Consequently, the separator 7 separates the leading edge 1*a* from the surface of the paper roll 1. The lading edge 1*a* separated from the paper roll 1 is brought to the roller 4. The paper sensor 8, FIG. 2, senses the leading edge 1*a* of the paper roll 1. In response to the resulting output of the paper sensor 8, the control means further drives the motor 11 by a preselected amount in order to convey the leading edge 1*a* to a preselected stand-by position.

On the other hand, assume that the leading edge 1*a* of the paper roll 1 is positioned between the front roller 2 and the rear roller 3 when the paper roll 1 is set on the two rollers 2 and 3. Then, even when the front roller 2 is locked and the rear roller 3 is rotated counterclockwise, the paper roll 1 does not slacken at all. This, coupled with the fact that the rear roller 3 is eventually locked, exerts an excessive load on the motor 11. At this instant, the torque limiter 15 slips and allows the motor 11 to continue its rotation. When a slack does not occur within a preselected period of time (it never occurs in this case), the control means determines that the leading edge 1*a* of the paper roll 1 exists between the front roller 2 and the rear roller 3, and interrupts the rotation of the motor 11. Subsequently, the control means turns off the solenoid 13 to thereby couple the front roller 2 to the motor 11 and again drives the motor 11. As a result, the leading edge 1*a* is brought out of the range between the front roller 2 and the rear roller 3. This is followed by the automatic loading operation described with reference to FIGS. 4–12.

With the above automatic loading operation, it is possible to automatically pay out the paper from the roll 1 to the preselected stand-by position. Specifically, only if the operator puts the paper roll 1 on the front roller 2 and rear roller 3 without regard to the position of the leading edge 1*a,* the leading edge 1*a* is automatically set at the stand-by position. This frees the operator from time- and labor-consuming work and thereby obviates human errors. Moreover, because the leading edge 1*a* is indirectly sensed via an intentional slack, the paper roll 1 can be automatically loaded without regard to its size or environmental conditions.

To cause the paper roll 1 to slacken, the illustrative embodiment locks the front roller 2 and drives only the rear roller 3. Alternatively, the rear roller 3 may be locked, in which case only the front roller 2 will be driven. Further, the front roller 2 and rear roller 3 may be respectively rotated clockwise and counterclockwise at the same time.

In summary, in accordance with the present invention, an automatic loading mechanism intentionally produces a slack on the surface of a paper roll, indirectly senses the leading edge of the paper of the roll via the slack, and conveys the leading edge to a preselected stand-by position. The mechanism is therefore capable of automatically paying out the paper even when a mark is absent at the leading edge. This allows not only a fresh paper roll but also a half-used paper roll to be automatically loaded.

Further, the above mechanism is simple because a single motor implements the entire drive necessary for automatic loading. In addition, the operator does not have to be careful about the position of the leading edge of the paper when setting the paper roll.

Various modifications will become possible for those skilled in the art after receiving the teachings of the present disclosure without departing from the scope thereof.

What is claimed is:

1. A mechanism for automatically loading a paper roll by rotating a front roller and a rear roller, which are positioned below a paper roll setting position and spaced from each other in a direction of paper feed, while causing a circumference of said paper roll to contact said front roller and said rear roller, said mechanism comprising:

a separator positioned between the front roller and the rear roller for separating a leading edge of paper of the paper roll from a surface of said paper roll;

slack sensing means for sensing a preselected amount of slack produced on the surface of the paper roll; and control means for controlling rotation of the front roller and the rear roller in accordance with an output signal of said slack sensing means;

wherein said control means rotates at least one of the front roller and the rear roller to thereby produce the preselected amount of slack between said front roller and said rear roller, then rotates said front roller and said rear roller in a direction opposite to the direction of paper feed, then further rotates, when said slack sensing means senses a decrease of the predetermined amount of slack, said front roller and said rear roller by a preselected amount, then stops rotating said front roller and said rear roller, and then rotates said front roller and said rear roller in the direction of paper feed, thereby feeding the leading edge of the paper to said separator.

2. A mechanism as claimed in claim 1, further comprising:

a single motor for driving the front roller and the rear roller; and a clutch arranged between said single motor and one of the front roller and the rear roller to be locked at a time of producing the slack, said clutch being capable of selectively interrupting drive transmission and locking said one of said front roller and said rear roller when interrupting drive transmission.

3. A mechanism as claimed in claim 2, further comprising a torque limiter arranged on a drive transmission path between said motor and the other of the front roller and the rear roller not to be locked, for interrupting drive transmission when a torque exceeding a preselected value acts on said other of said front roller and said rear roller.

4. A mechanism as claimed in claim 3, wherein said control means determines, if the predetermined amount of slack does not occur within a preselected period of time despite a locking of said one of the front roller and the rear roller and a rotation of said other of said front roller and said rear roller, that the leading edge of the paper is positioned between said front roller and said rear roller, then interrupts the rotation of said other of said front roller and said rear roller, then couples said clutch and thereby rotates said front roller and said rear roller to thereby move said leading edge away from a range between said front roller and said rear roller, then locks said one of said front roller and said rear roller while rotating said other of said front roller and said rear roller to thereby produce the preselected amount of slack on the surface of the paper roll, then rotates said front roller and said rear roller in the direction opposite to the direction of paper feed, then further rotates, when said slack sensing means senses a decrease of said preselected amount of slack, said front roller and said rear roller by a preselected amount, then stops rotating said front roller and said rear roller, and then rotates said front roller and said rear roller in the direction of paper feed to thereby convey said leading edge to said separator.

* * * * *